United States Patent [19]

Wevers et al.

[11] Patent Number: 4,714,565

[45] Date of Patent: Dec. 22, 1987

[54] HOMOGENEOUS CONCENTRATED LIQUID DETERGENT COMPOSITIONS CONTAINING A MONOESTER OF A DICARBOXYLIC ACID

[75] Inventors: Jean Wevers, Grimbergen; Christian R. Barrat, Brussels, both of Belgium; Frederick E. Hardy, Newcastle upon Tyne, United Kingdom

[73] Assignee: The Procter & Gamble Company, Cincinnati, Ohio

[21] Appl. No.: 856,085

[22] Filed: Apr. 25, 1986

[30] Foreign Application Priority Data

May 3, 1985 [GB] United Kingdom ..... 8511305

[51] Int. Cl.[4] ..... C11D 1/83

[52] U.S. Cl. ..... 252/174.19; 252/174.21; 252/559; 252/DIG. 14; 560/76; 560/190

[58] Field of Search ..... 252/DIG. 14, 174.19, 252/559, 174.21, 174.22; 560/540, 76, 190

[56] References Cited

U.S. PATENT DOCUMENTS

| | | | |
|---|---|---|---|
| 3,816,318 | 6/1974 | Hentschel | 252/89 |
| 4,285,841 | 8/1981 | Barrat et al. | 252/559 |
| 4,446,043 | 5/1984 | Tai | 252/105 |
| 4,507,219 | 3/1985 | Hughes | 252/118 |
| 4,559,150 | 12/1985 | Becker et al. | 252/8.6 |

FOREIGN PATENT DOCUMENTS

| | | |
|---|---|---|
| 1133061 | 5/1961 | Fed. Rep. of Germany . |
| 772538 | 10/1934 | France . |
| 1027083 | 5/1953 | France . |

OTHER PUBLICATIONS

Pending U.S. Patent Application Ser. No. 856,081.
Pending U.S. Patent Application Ser. No. 856,086.

*Primary Examiner*—Paul Lieberman
*Assistant Examiner*—Hoa Van Le
*Attorney, Agent, or Firm*—Donald E. Hasse; Thomas H. O'Flaherty; Richard C. Witte

[57] ABSTRACT

Homogeneous concentrated liquid detergent compositions containing specific monoesters of dicarboxylic acids are disclosed. Substantial levels of nonionic surfactants are present. Preferred compositions additionally contain low levels of oleic acid.

9 Claims, No Drawings

HOMOGENEOUS CONCENTRATED LIQUID DETERGENT COMPOSITIONS CONTAINING A MONOESTER OF A DICARBOXYLIC ACID

TECHNICAL FIELD

The present invention relates to liquid detergent compositions which include substantial levels of nonionic surfactants and contain a monoester of a dicarboxylic acid as an hydrotrope.

The compositions of the invention are stable, homogeneous and give outstanding cleaning performance.

BACKGROUND OF THE INVENTION

Concentrated homogeneous heavy duty liquid detergent compositions are well-known in the art, and have found commercial application.

These compositions often comprise a mixture of anionic and nonionic surfactants, and generally contain electrolytes; but it has been recognized that the presence of electrolytes in concentrated liquid detergent compositions can be detrimental to the solubility of nonionic surfactants and therefore hydrotropes and/or solvents are included in the compositions.

However, conventional hydrotropes are not suitable in compositions containing less than 50% of water.

Cumene and xylene sulfonates in particular are not effective in such compositions. Other hydrotropes or compatibilizing agents, such as water-soluble solvents, can have deleterious effects: ethanol may lead to enzyme destabilization, and polyols are less desirable in presence of perfumes.

We have now found that these drawbacks can be overcome by the use of a specific class of monoesters which can function as hydrotropes in concentrated liquid detergent compositions containing less than 50% of water.

We have also found that the compositions herein, in addition to stability benefits, show improved cleaning performance.

The prior art relative to concentrated homogeneous heavy duty liquid detergent compositions is crowded and diverse. As an example U.S. Pat. No. 4,285,841 discloses builder-free concentrated homogeneous liquid compositions containing a combination of anionic synthetic surface-active compounds, nonionic surface-active compounds and fatty acids. The manufacture of the like compositions containing less than 50% water requires the utilization of substantial amounts of solvents and/or compatibilizing agents and even under those circumstances, remain of borderline stability having particularly regard to levels and types of nonionics, fatty acids, especially saturated species, and optional electrolytes such as low levels of organic builders.

The necessity to limit the level of nonionic surfactants due to increase of viscosity and phase separation problems is recognized e.g. in EP No. 0 074 134.

Monoesters of dicarboxylic acids have been used for various purposes in detergent technology, for example:

as surfactants and softening agents, FR No. 772.538;
as emulsifying agents, FR No. 1.027.083;
as suds suppressors, DE No. 22 54 287;
as soap replacements, DE No. 11 33 061;
as builders, DE No. 22 28 252.

The art-utilization of the dicarboxylic monoesters of the above references is different from, and not suggestive of the technology herein.

It is an object of the present invention to provide stable, homogeneous concentrated liquid detergent compositions, containing high levels of active ingredients, inclusive of nonionic surfactants and electrolytes.

It is a further object of the present invention to provide a detergent composition with outstanding cleaning performance.

SUMMARY OF THE INVENTION

The present invention relates to stable, homogeneous concentrated liquid detergent compositions, containing less than 50% by weight of water;
from 10% to 50% by weight of a mixture of anionic and nonionic surface-active agents;

characterized in that they further contain at least 5% by weight, of the total composition, of a non-ionic surface-active agent;
from 2% to 50% by weight of a water-insoluble monoester of a dicarboxylic acid having the formula

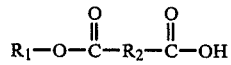

wherein $R_1$ is an alkyl or alkylaryl-group having from 8 to 20 carbon atoms, $R_2$ is a saturated or unsaturated aliphatic moiety having from 1 to 8 carbon atoms or a saturated or unsaturated cyclic moiety with the proviso that the sum of the carbon atoms in $R_1+R_2$ is at least 12.

The compositions of the invention have a pH, 1% solution in water at 20° C., in the range of from 6 to 9.

DETAILED DESCRIPTION OF THE INVENTION

Organic synthetic surface-active agents

The surface-active agents can be selected from anionic synthetic and nonionic surfactants. While these surfactant components can be used over a wide concentration range, they are normally used in levels ranging from 10% to 50% by weight of the detergent compositions.

Anionic surfactants

Suitable anionic synthetic surface-active agents can be selected from the group of sulfonates and sulfates. The like anionic surfactants can be represented by the general formula $R^1SO^3M$ wherein $R^1$ represents a hydrocarbon group selected from the group consisting of straight or branched alkyl radicals containing from 8 to 24 carbon atoms and alkyl phenyl radicals containing from 9 to 15 carbon atoms in the alkyl group. M is a salt forming cation which typically is selected from the group consisting of sodium, magnesium, potassium, ammonium, monoalkanolammonium, dialkanolammonium, trialkanolammonium and mixtures thereof.

A preferred synthetic anionic surfactant is a water-soluble salt of an alkylbenzene sulfonic acid containing from 9 to 15 carbon atoms in the alkyl group. Another preferred synthetic anionic surfactant is a water-soluble salt of an alkyl polyethoxylate ether sulfate wherein the alkyl group contains from 8 to 24 carbon atoms and having from 1 to 20 ethoxy groups.

Nonionic surfactants

The nonionic surface-active agents are present in a level of at least 5% by weight of the total composition, preferably from 8% to 20% by weight of the total composition.

The nonionic surfactant components contain a hydrophobic organic radical condensed with an ethylene oxide hydrophilic moiety. All ethoxylated nonionic surfactants which are known to be suitable for use in detergent application can be used in the compositions of this invention. Preferred nonionic species herein are polyethoxylates derived from primary and secondary aliphatic alcohols having from 8 to 24 carbon atoms, and having a HLB (hydrophilic-liphilic balance) in the range from 9 to 15. These preferred ethoxylates frequently contain from 2 to 14 moles of ethylene oxide per mole of hydrophobic moiety. The hydrocarbyl chain (hydro-phobic moiety) can be represented by linear or branched fatty alcohols.

A preferred class of nonionic ethoxylates is represented by the condensation product of a fatty alcohol having from 12 to 15 carbon atoms and from 4 to 10 moles of ethylene oxide per mole of fatty alcohol. Suitable species of this class of ethoxylates include: the condensation product of $C_{12}$–$C_{15}$ oxo-alcohols and 7 moles of ethylene oxide per mole of alcohol; the condensation product of narrow cut $C_{14}$–$C_{15}$ oxo-alcohols and 7 or 9 moles of ethylene oxide per mole of fatty (oxo)alcohol; the condensation product of a narrow cut $C_{12}$–$C_{13}$ fatty (oxo)alcohol and 6.5 moles of ethylene oxide per mole of fatty alcohol; and the condensation products of a $C_{10}$–$C_{14}$ coconut fatty alcohol with a degree of ethoxylation (moles EO/mole fatty alcohol) in the range from 5 to 8. The fatty oxo alcohols while mainly linear can have, depending upon the processing conditions and raw material olefins, a certain degree of branching, particularly short chain such as methyl branching. A degree of branching in the range from 15% to 50% (weight %) is frequently found in commercial oxo-alcohols.

Preferred nonionic ethoxylated components can also be represented by a mixture of 2 separately ethoxylated nonionic surfactants having a different degree of ethoxylation. For example, the nonionic ethoxylate can be represented by mixtures of a first ethoxylated surfactant contaning from 3 to 7 moles of ethylene oxide per mole of hydrophobic moiety and a second ethoxylated species having from 8 to 14 moles of ethylene oxide per mole of hydrophobic moiety. A preferred nonionic ethoxylated mixture contains a lower ethoxylate which is the condensation product of a $C_{12}$–$C_{15}$ oxo-alcohol, with up to 50% (wt) branching, and from about 3 to 7 moles of ethylene oxide per mole of fatty oxo-alcohol, and a higher ethoxylate which is the condensation product of a $C_{16}$–$C_{19}$ oxo-alcohol with more than 50% (wt) branching and from about 8 to 14 moles of ethylene oxide per mole of branched oxo-alcohol.

The anionic and nonionic surface-active agents are frequently used in a weight ratio of anionic:nonionic of from 4:1 to 1:4, preferably 2:1 to 1:2.

The monoesters

The water-insoluble monoesters useful herein can be prepared by known methods from a selected class of dicarboxylic acids (or anhydrides) and alcohols. The said monoesters have the formula:

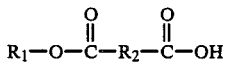

wherein $R_1$ is an alkyl or alkylaryl group having from 8 to 20 carbon atoms; $R_1$ is preferably straight chain but may be branched; $R_2$ is a saturated or unsaturated aliphatic moiety having from 1 to 8 carbon atoms, or a saturated or unsaturated cyclic moiety. Substituents such as alkyl groups may be branched on the $R_2$ chain.

The criticality of the dicarboxylic acids and alcohols useful herein is defined by the sum of the carbon atoms in $R_1+R_2$, which must be at least 12, preferably 14 to 26.

Examples of suitable dicarboxylic acids and/or anhydrides used to prepare the monoesters herein include malonic, succinic, glutaric, adipic, pimelic, suberic, azelaic, sebacic, maleic, fumaric, phthalic, isophthalic, terephthalic, diphenic acids/anhydrides.

Examples of suitable alcohols used to prepare said monoesters include aliphatic alcohols like octanol, nonanol decanol, undecanol, dodecanol, tridecanol tetradecanol, pentadecanol, hexadecanol, heptadecanol, octadecanol, nonadecanol, duodecanol, and phenol derivatives of the same alcohols.

Most preferred monoesters for use herein include succinates, such as dodecanol succinate, phthalates such as tridecanol phthalate, tetradecanol phthalate, pentadecanol phthalate, hexadecanol phthalate, heptadecanol phthlate, octadecanol phthalate. The term "phthalate" herein encompasses esters obtained from phthalic, isophthalic, or terephthalic anhydrides; the monoesters described hereinabove are present at levels ranging from 2% to 50% by weight of the composition, preferably from 8% to 30% by weight.

The compositions herein contain less than 50% usually from 15% to 40% by weight of water.

The claimed compositions are further characterized by a pH, measured in 1% by weight aqueous solution, in the range from about 6 to 9.

Optical Ingredients

In addition to the essential ingredients described hereinbefore, the compositions herein frequently contain a series of optional ingredients which are used for their known functionality in conventional quantities.

A first example of the like optional ingredients is represented by adjunct surfactants.

Such optional surfactants include:

water-soluble amine oxides containing one alkyl moiety of from about 10 to 24 carbon atoms and two moieties selected from the group consisting of alkyl moieties and hydroxyalkyl moieties containing from 1 to about 3 carbon atoms. Specific examples are: dodecyldimethylamine oxides dodecyldiethylamine oxide, tetradecyldi(hydroxyethyl)amine oxide;

alk(en)yl succinates of the formula:

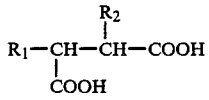

wherein $R_1$ is an alk(en)yl radical, having from 10 to 20C-atoms, and $R_2$ is hydrogen or $C_1$–$C_4$ alkyl.

Specific examples of the above succinates are 2-dodecenylsuccinic acid, 2-tetradecenylsuccinic acid, 2-hexadecenylsuccinic acid, decyl succinic acid, dodecyl succinic acid and tetradecyl succinic acid and the water-soluble salts thereof.

The adjunct surfactants can also be represented by ampholitic surface-active agents, such as sodium 3-(dodecylamino)propionate, and sodium 3-(dodecylamino)propane-1-sulfonate, and by zwitterionic surfactants such as (N,N-dimethyl-N-hexadecylammonio)-2-hydroxypropane-1-sulfonate.

The adjunct surfactant does not represent more than 35%, preferably 20% by weight, of the sum of essential anionic-nonionic surfactant component plus adjunct surfactant.

Other examples of optional ingredients can include fatty acids, saturated and/or unsaturated, and the corresponding soaps, water-insoluble solvents, enzymes, enzyme stabilizers, polyacids, suds regulants, brighteners, perfumes, antioxidants, dyes, antioxidants, bactericides, corrosion inhibitors, fabric-softening agents, phase regulants and the like.

Suitable fatty acids, saturated or unsaturated, have from 10 to 18 carbon atoms in the alkyl chain. Preferred are unsaturated species having from 14 to 18 carbon atoms in the alkyl chain, most preferably oleic acid. The corresponding soaps can equally be used. The optional fatty acid/soaps are used in levels up to 10% preferably from 1% to 8% by weight (of the composition). The fatty acids/soaps, among others, act as suds modifiers/-regulants.

Detergent enzymes generally aid and augment the removal of specific stains. Suitable enzymes can be represented by proteases, amylases, lipases, glucose-oxidases, cellulase, or mixtures thereof. Proteases and amylases are preferred in the claimed liquid concentrated compositions. They are frequently employed in a level from about 0.01% to about 1%.

All generally known enzyme stabilizing systems can be used in the compositions herein in the art established level. Examples of suitable stabilizing systems include short $C_{1-4}$ chain carboxylic acid, particularly formic acid in combination with low level of calcium, boric acid and the water-soluble salts thereof possibly in combination with polyols.

Another preferred optional ingredient is represented by a polyacid or mixture of polyacids in an amount from about 0.05% to about 2% by weight. Suitable polyacids are those having one pK value of at least 5. Preferred polyacid species for use herein can be represented by organophosphonic acids, particularly alkylene-polyaminopolyalkylene phosphonic acids such as ethylene diamine tetramethylenephosphonic acid, and diethylene triaminepentamethylenephosphonic acid or the salts thereof.

Non-fatty acid detergent suds regulants can also be used. Preferred species include alkylated polysiloxanes such as dimethylpolysiloxane also frequently termed silicone. The silicones are frequently used in a level not exceeding 0.5%, most preferably between 0.01% to 0.2% by weight.

Soil release polymers can also be incorporated in the compositions herein. Suitable species of such release polymers are described in U.S. patent application Ser. No. 684,511, filed Dec. 21, 1984, incorporated herein by reference.

The phase regulant is a further optional ingredient in the compositions herein. This component together with water can constitute the solvent matrix for the claimed concentrated liquid compositions. Suitable ingredient classes include lower aliphatic alcohols having from 2 to 6 carbon atoms and from 1 to 3 hydroxyl groups, ethers of diethyleneglycol and lower aliphatic monoalcohols having from 1 to 4 carbon atoms. Specific examples of phase regulants are: ethanol; n-propanol; isopropanol; butanol; 1,2-propanediol; 1,3-propanediol; monomethyl-, ethyl-, propyl-, and monobutyl ethers of diethylene glycol.

The claimed invention is illustrated and clarified with the aid of the following examples.

Heavy duty concentrated liquid detergents have been prepared as follows.

| Ingredients | % by weight | | | |
|---|---|---|---|---|
| | Comp. A | Ex. I | Ex. II | Ex. III |
| Dodecylbenzenesulphonic acid | 10.00 | 10.00 | 5.00 | 5.00 |
| $C_{13-15}$ EO7 | 15.00 | 15.00 | 10.00 | 10.00 |
| Coconut($C_{12}$–$C_{14}$)alkyl-sulphate-TEA salt | 5.00 | 5.00 | 5.00 | — |
| Diethylenetriaminepenta-methylenephosphonic acid | 1.00 | 1.00 | 1.00 | 1.00 |
| Citric acid-Na salt | 2.00 | 2.00 | 2.00 | 2.00 |
| Sodiumformate | 2.00 | 2.00 | 2.00 | 2.00 |
| $C_{12.14}$ fatty acids.Na salt | — | — | 10.00 | — |
| 2-Dodecenylsuccinate-Na salt | — | — | — | 10.00 |
| Sodiumtoluenesulphonate | 10.00 | — | — | — |
| Dodecanol-succinic anhydride monoester-Na salt | — | 10.00 | 10.00 | 10.00 |
| Triethanolamine | 10.00 | 10.00 | 6.00 | 6.00 |
| Protease | 1.00 | 1.00 | 1.00 | 1.00 |
| Amylase | 0.10 | 0.10 | 0.10 | 0.10 |
| Fluorescent whitening agent | 0.20 | 0.20 | 0.20 | 0.20 |
| Perfume | 0.50 | 0.50 | 0.50 | 0.50 |
| Ethanol | 10.00 | 10.00 | 10.00 | 10.00 |
| Water | | up to 100 | | |
| pH | 7.8 | 7.8 | 7.8 | 7.8 |

The above concentrated compositions contain less than 40% of water.

Nonionic surfactant is present at a high level, and several electrolytes are included.

Phase stability testing has resulted into a clear homogeneous stable solution for the compositions of Examples I, II, III, where dodecanol-succinic anhydride monoester salt was used as an hydrotrope.

On the contrary, prior art composition A containing a conventional hydrotrope revealed a high degree of phase instability, resulting into phase separation.

In addition, following concentrated heavy duty liquid compositions have been prepared.

| Ingredients | % by weight | |
|---|---|---|
| | Ex. IV | Ex. V |
| Dodecylbenzenesulphonic acid | 10.00 | 10.00 |
| $C_{13-15}$ EO7 | 15.00 | 10.00 |
| Coconut($C_{12}$–$C_{14}$)alkyl-sulphate-TEA salt | 5.00 | 5.00 |
| Diethylenetriaminepenta-methylenephosphonic acid | 1.00 | 1.00 |
| Citric acid-Na salt | 2.00 | 2.00 |
| Sodiumformate | 2.00 | 2.00 |
| Dodecanol-succinic anhydride monoester-Na salt | 20.00 | 20.00 |
| Triethanolamine | 10.00 | 10.00 |
| Protease | 1.00 | 1.00 |
| Amylase | 0.10 | 0.10 |
| Fluorescent whitening agent | 0.20 | 0.20 |
| Perfume | 0.50 | 0.50 |
| Ethanol | 10.00 | 10.00 |
| Water | up to 100 | |
| pH | 7.8 | |

The compositions of Examples I, IV, and V have been performance tested.

This performance evaluation (1) has revealed significant improvements for the compositions of Examples I, IV, and V, vs. prior art composition A.

| Stain-type | % removal | | | |
|---|---|---|---|---|
| | Comp. A | Ex. I | Ex. IV | Ex. V |
| Greasy (2) | 20 | 50 | 60 | 50 |
| Tea | 15 | 25 | 35 | 35 |
| Blood | 40 | 55 | 60 | 62 |

(1) Small scale launder-o-meter testing; heat-up cycle to 60° C. - total wash time; 50 minutes.
(2) Average between lipstick, make-up, shoe-polish.

We claim:

1. A concentrated homogeneous liquid detergent composition containing:
(a) from 10% to 50% by weight of a mixture of anionic synthetic and nonionic surface-active agents;
(b) less than 50% by weight of water;
(c) from 2% to 50% by weight of a water-soluble monoester of a dicarboxylic acid selected from the group consisting of dodecanol succinate, tridecanol phthalate, tetradecanol phthalate, pentadecanol phthalate, hexadecanol phthalate, heptadecanol phthalate, and octadecanol phthalate,
(d) the non-ionic surface-active agent is present at a level of at least 5% by weight of the total composition; and
(e) said composition has a pH, in a 1% solution in water at 20° C., in the range of from 6 to 9 and said composition is free of cumene and xylene sulfonate hydrotropes.

2. The composition in accordance with claim 1 wherein the weight ratio of anionic to nonionic surface-active agents is in the range from 4:1 to 1:4.

3. The composition in accordance with claim 1 wherein the water-soluble monoester is present at levels of from 8% to 30% by weight.

4. The composition in accordance with claim 1 wherein the nonionic surfactant component represents from 8% to 20% by weight of the total composition.

5. The composition in accordance with claim 4 wherein the weight ratio of anionic to nonionic surface-active agent is in the range from 2:1 to 1:2.

6. The composition in accordance with claim 1 which contains from 15% to 40% by weight of water.

7. The composition in accordance with claim 1 which in addition, contains from 1% to 8% by weight of a $C_{10}$–$C_{18}$ fatty acid.

8. The composition in accordance with claim 6 which in addition contains from 0.01% to 0.25% by weight of an antioxidant.

9. The composition in accordance with claim 1 wherein the water-soluble monester is dodecanol succinate.

* * * * *